US009153124B2

(12) United States Patent
Watts et al.

(10) Patent No.: US 9,153,124 B2
(45) Date of Patent: Oct. 6, 2015

(54) ALARM SENSOR SUPPORTING LONG-RANGE WIRELESS COMMUNICATION

(71) Applicants: Wesley Watts, Dallas, GA (US); Edward Corner, Brevard, NC (US)

(72) Inventors: Wesley Watts, Dallas, GA (US); Edward Corner, Brevard, NC (US)

(73) Assignee: Numerex Corp., Atlanta, GA (US)

( * ) Notice: Subject to any disclaimer, the term of this patent is extended or adjusted under 35 U.S.C. 154(b) by 168 days.

(21) Appl. No.: 14/013,637

(22) Filed: Aug. 29, 2013

(65) Prior Publication Data

US 2014/0062693 A1 Mar. 6, 2014

Related U.S. Application Data

(60) Provisional application No. 61/694,883, filed on Aug. 30, 2012, provisional application No. 61/696,902, filed on Sep. 5, 2012.

(51) Int. Cl.

| | |
|---|---|
| ***G08B 1/08*** | (2006.01) |
| ***G08B 27/00*** | (2006.01) |
| ***G08B 25/00*** | (2006.01) |
| ***G08B 25/08*** | (2006.01) |
| *G08B 17/00* | (2006.01) |

(52) U.S. Cl.

CPC ..... *G08B 27/006* (2013.01); *G08B 25/009* (2013.01); *G08B 25/08* (2013.01); *G08B 17/00* (2013.01)

(58) Field of Classification Search

None

See application file for complete search history.

(56) References Cited

U.S. PATENT DOCUMENTS

| | | | | |
|---|---|---|---|---|
| 5,726,634 | A | 3/1998 | Hess et al. | |
| 7,135,959 | B2 * | 11/2006 | Wagner et al. | 340/286.11 |
| 7,283,057 | B2 | 10/2007 | Kim | |
| 7,567,174 | B2 | 7/2009 | Woodard et al. | |
| 7,656,287 | B2 | 2/2010 | Albert et al. | |
| 7,701,332 | B2 | 4/2010 | Anderson | |
| 8,149,109 | B2 | 4/2012 | Lontka | |
| 8,188,869 | B2 | 5/2012 | Wangrud | |
| 2006/0012466 | A1 * | 1/2006 | Wagner et al. | 340/286.11 |
| 2008/0191857 | A1 * | 8/2008 | Mojaver | 340/500 |
| 2008/0224851 | A1 * | 9/2008 | Pumpelly et al. | 340/538 |
| 2009/0191839 | A1 * | 7/2009 | Cannon, Jr. | 455/404.1 |
| 2010/0097210 | A1 * | 4/2010 | Tyroler et al. | 340/540 |
| 2010/0222052 | A1 | 9/2010 | Barzegar et al. | |
| 2012/0112920 | A1 * | 5/2012 | Ramdeo | 340/628 |
| 2013/0154823 | A1 * | 6/2013 | Ostrer et al. | 340/539.1 |

OTHER PUBLICATIONS

International Search Report for PCT/US2013/57287, issued Nov. 22, 2013.

* cited by examiner

*Primary Examiner* — Travis Hunnings

(74) *Attorney, Agent, or Firm* — King & Spalding LLP

(57) ABSTRACT

An alarm sensor can be located at a premises, for example a smoke detector mounted to a wall or ceiling of a building. In response to an alarm event, such as detection of a level of smoke indicative of a fire hazard, the alarm sensor can send a wireless notification directly to a remote recipient that is offsite from the premises. The recipient could be a smart phone or other handheld cellular device carried by a home-owner on vacation, for example. The alarm sensor can be either originally manufactured with remote notification capabilities or retrofitted after installation for remote notification. In some cases, the alarm sensor can be networked with other alarm sensors located at the premises. For example, an alarm sensor having remote notification capabilities can receive alarm notifications from other alarm sensors for relay to the remote recipient.

40 Claims, 11 Drawing Sheets

ALARM SENSOR SUPPORTING LONG-RANGE WIRELESS COMMUNICATION

CROSS REFERENCE TO RELATED APPLICATIONS

This application claims priority to U.S. Provisional Patent Application No. 61/694,883 filed Aug. 30, 2012 and U.S. Provisional Patent Application No. 61/696,902 filed Sep. 5, 2012, each in the name of Wesley Watts and Edward Comer and entitled "Method and System for Converting Existing Smoke Alarms for Remote Wireless Alerting," the entire contents of which are hereby incorporated herein by reference.

FIELD OF THE TECHNOLOGY

The present technology relates to alarms and more particularly to an alarm detector, such as a smoke detector, having a capability to send alarm notifications to a remote recipient.

BACKGROUND

Numerous types of ceiling or wall mounted smoke detecting devices are in common use in homes and businesses. Such devices may be powered by integrated batteries; low voltage electrical power wired to the unit from either a dedicated transformer or an alarm security panel; or commercial power, such as 110 volts alternating current ("VAC"). Most such smoke detecting devices sound an alarm local to the site of the detected smoke conditions, but some may also trigger reporting via an alarm security panel to which the smoke detecting device is connected.

Conventional technologies for such smoke alarm detectors date to U.S. Pat. No. 3,717,862 granted to Koju Sasaki on Oct. 9, 1970 and may include technology disclosed in U.S. Pat. No. 4,004,288 granted to William Webb, Jr. on Jan. 18, 1977. Some conventional smoke detecting devices that are connected to alarm security panels may report smoke detection events to a remote monitoring entity by using communication capabilities of the panel. In contrast, conventional smoke detecting devices that are not connected to alarm security panels are generally incapable of reporting events to a remote monitoring entity. In such devices, reporting is generally limited to sounding an alarm at the site of the detected smoke conditions, which may or may not be detected by a nearby person. In many situations, this local alarm mechanism may offer a less than ideal level of notification capabilities for individuals and property monitored by the smoke detecting device.

U.S. Pat. No. 3,967,258 issued to Fred Bucy, Jr. on Jun. 29, 1976 includes disclosure relating to the use of continuous wireless radio frequency signals to interconnect surveillance system detectors to a receiver included within a central console which has an antenna in the attic or overhead, or in a crawl space under a building. U.S. Pat. No. 4,160,246 granted to Stephen M. Martin on Oct. 3, 1977 includes disclosure relating to connecting a smoke detecting device to an alarm security panel via short-range wireless signals.

However, known conventional smoke alarm detectors lack suitable provisions for reporting events from an intermediary or secondary smoke alarm detector to primary smoke alarm detectors equipment via short-range wireless radio signals. Additionally, conventional smoke alarm detectors lack suitable provisions for reporting events directly from a smoke alarm detector to a remote monitoring center or other site via long-range wireless signals, such as digital cellular telecommunications systems, without the use of intermediary onsite equipment, such as an alarm system panel. The absence of such provisions reduces the utility of existing smoke alarm detectors. Furthermore, their reliance upon intermediary onsite equipment, such as alarm system panels, introduces complexity and expenses associated with installation, service, and maintenance.

Accordingly, there are needs in the art for improved alarm detectors, including with improved communication and networking capabilities. For example, need exists for a smoke alarm detector that can directly send event alerts via commercial wireless digital data telecommunications channels, such as digital cellular telecommunications systems, to a remote monitoring entity, without intermediary equipment, such as an alarm system panel. Fulfilling this need could potentially lower installation costs and support cost effective solutions for protection. As another example, need exists for a retrofit apparatus that enables existing and already installed smoke alarm detectors to, without onsite intermediary equipment, directly send event alerts via commercial wireless digital data telecommunications channels, such as digital cellular telecommunications systems, to a remote monitoring entity. Fulfilling this need could potentially also lowering installation costs and support cost effective solutions for life, safety and property protection by enabling the re-use and salvage of existing installed smoke alarm detectors.

A capability addressing one or more such needs, or some other related deficiency in the art, would enhance detection and reporting of alarm events.

SUMMARY

An alarm sensor can be located at a premises, for example attached to a wall or ceiling of a building such as a home or office. In certain embodiments, the alarm sensor can comprise a smoke alarm detector that issues an alarm when smoke reaches a level indicative of a hazardous fire. In other embodiments, the alarm sensor may detect a burglar intrusion or other invasion when a window is broken or opened unexpectedly or may sense carbon monoxide or some other condition, hazard, or parameter that may warrant issuing an alarm.

The alarm sensor can send a wireless notification for receipt offsite of the premises. In some embodiments, the recipient of the notification may comprise a smartphone or other handheld cellular device carried by an owner of the premises who may be at work or on vacation, for example. In other embodiments, the recipient may comprise a server that is located offsite of the premises and that forwards the notification to a central monitoring station, to a cellular handheld device, or to some other recipient, for example.

The alarm sensor can be either originally manufactured with remote notification capabilities or retrofitted to support remote notification after installation at the premises. Additionally, the alarm sensor can be retrofitted after user purchase but prior to installation.

In some embodiments, the alarm sensor can be networked with other alarm sensors located at the premises. For example, an alarm sensor having remote notification capabilities can receive alarm notifications from other alarm sensors for relay to the remote recipient. In some embodiments, such an alarm sensor network may transmit local notifications or sensor data among alarm sensors in a serial or daisy chain fashion, with one or more of those sensors having a capability to send a remote notification according to such local notifications or sensor data. In some embodiments, such an alarm sensor network may transmit local notifications or sensor data among alarm sensors in a parallel or branch hierarchy. For example, one alarm sensor may have a capability to send a remote notification based on local notifications or sensor data received directly from multiple other alarm sensors at the premises.

The foregoing discussion of alarm sensors having remote notification and networking capabilities is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1:
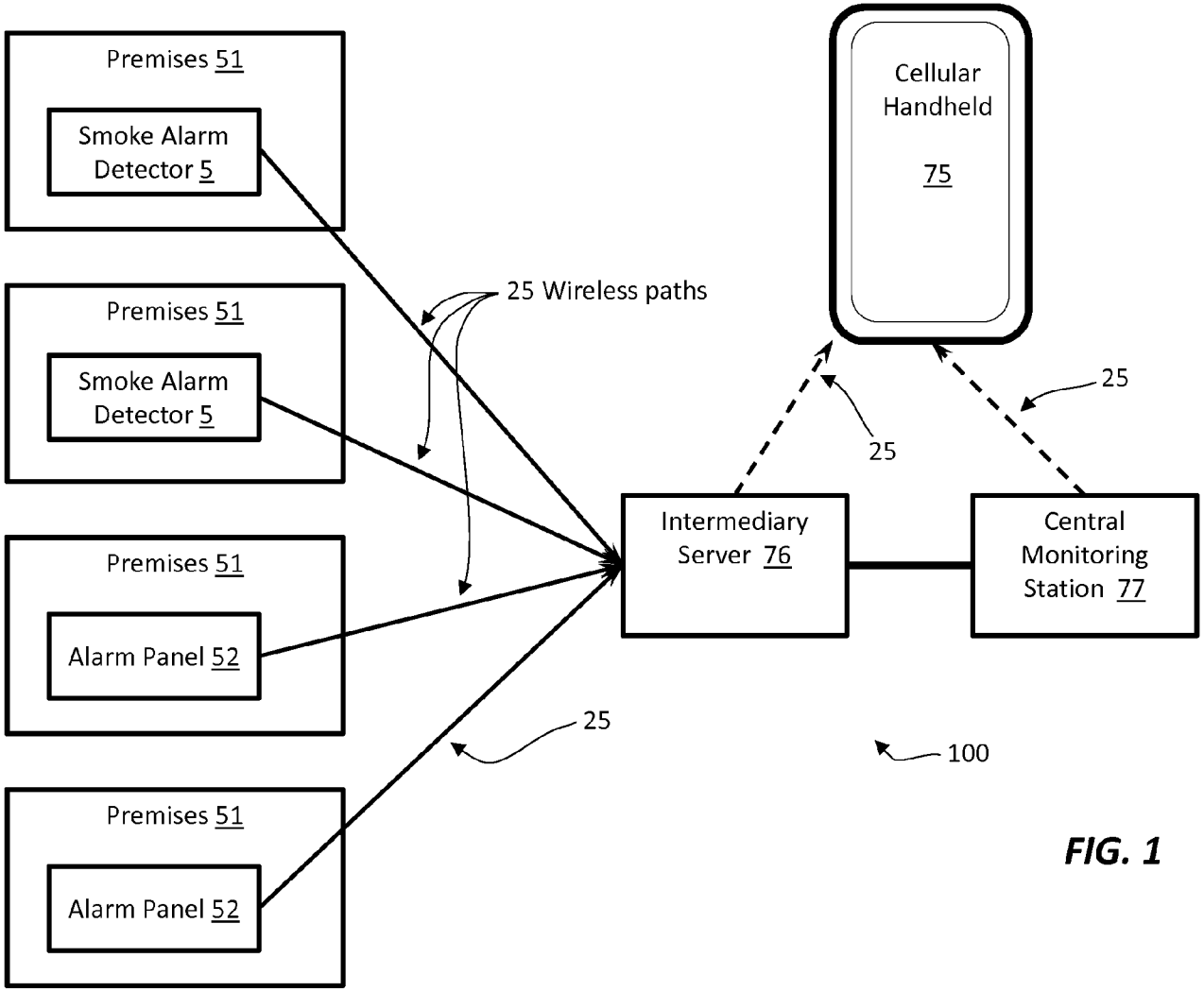
FIG. 1 is a functional block diagram of a system whereby smoke alarm detectors located at various premises communicate with a cellular handheld device through an intermediary server that also serves alarm panels at other premises, in accordance with some example embodiments of the present technology.

Many aspects of the technology can be better understood with reference to the above drawings. The elements and features shown in the drawings are not necessarily to scale, emphasis being placed upon clearly illustrating the principles of example embodiments of the present technology. Moreover, certain dimensions may be exaggerated to help visually convey such principles.

DESCRIPTION OF EXAMPLE EMBODIMENTS

Representative embodiments of the present technology relate generally to security condition detection and reporting and alarm apparatus.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

In some example embodiments, a retrofit system enables existing smoke alarm detectors to send event alerts via a conventional, wireless communications link, such as one or more digital cellular telecommunications systems. So retrofitted, a smoke alarm detector is capable of communicating an alarm event signal or status signal over an extended distance to a remote monitoring entity, such as a central monitoring station, an intermediary data collection and processing site, or a recipient with a cellular radiotelephone or other wireless communications device.

In some example embodiments, a retrofit kit comprises a retrofit system that upgrades an existing, externally powered smoke alarm detector for long-range wireless communications, such as digital cellular telecommunications systems. The retrofit system can comprise an adapter ring apparatus that is configured and physically positioned or "sandwiched" between the main unit of the existing smoke alarm detector and the mounting base of the existing smoke alarm detector.

In the alternative, the existing smoke alarm detector may be a monolithic unit that lacks a separable mounting base and thus is configured for mounting directly to a wall, ceiling, or other structure. For such an existing smoke alarm detector, the retrofit system can be housed in an enclosure, such as a cowling, that attaches to and may partially or wholly enclose the existing smoke alarm detector.

In both the adapter ring configuration and the cowling configuration, the retrofit system can be configured for long-range communication, such as with an entity at a remote location. Such communication can comprise transmitting notifications or other information about an alarm detection event and/or, in certain scenarios or embodiments, status information. The recipient can comprise a remote monitoring site, an intermediary collection and processing site, or a designated recipient (for example, an end user with a receiver, such as a "smartphone") via a long-range wireless communications link. The term "smartphone," as used herein, generally refers to a mobile phone with built-in applications and Internet access. The long-range wireless communications link can provide an extended communications range when compared to a conventional short-range wireless communication link, which is typically capable of communicating a wireless signal over a short distance, usually proximate to the transmitter and within 100 meters or less.

In some example embodiments, the retrofit system can comprise an adapter ring apparatus housing logic circuitry, a microprocessor, and a long-range wireless radio device. The radio device can comprise one or more transmitters, one or more receivers, or one or more transceivers. For example, the radio device may comprise a radiotelephone capable of data communications via conventional wireless digital data telecommunications channels. In some embodiments, communication of alarm events or status signals occurs over a data communication channel that may be distinct from voice. When the logic circuitry and microprocessor determine that the smoke alarm detector has detected an alarm event or is in a trouble state, the adapter ring apparatus can send a notification to one or more remote destinations via the long-range wireless radio device.

The adapter ring apparatus may be constructed in size and general configuration according to the existing detector housing and base and may use similar and compatible rotating locking tabs to attach to both the base and the main unit of the smoke alarm detector. For certain embodiments, electrical power for the retrofit system is provided by a dedicated battery. For other embodiments, electrical power is provided by an external source, such as electrical power distributed to or available from the existing smoke alarm detector. Some embodiments are configured to operate on an external electrical power source and can rely on a battery for a back-up or redundant power source.

In some example embodiments, the adapter ring apparatus uses a wired connection to the existing smoke alarm detector for access to electrical power (if access to external power is utilized) and for communication of alarm event detection and status signals. A wiring adapter may be utilized for connection to an existing connector and/or receptacle of the legacy smoke alarm detector that is being retrofitted. Such a wiring adapter can carry electrical power and/or alarm event detection and status signals from the existing detector to the adapter ring apparatus, for example.

Some other example embodiments of the retrofit system utilize a short-range wireless connection in place of a wired connection or to augment the wired connection. For example, the retrofit system may utilize Bluetooth, zigbee, zwave, infrared, acoustic, visible light, ultrasonic, or some other appropriate form of known wireless communications in connection with detecting and recognizing when the smoke alarm detector is in (or transitions to) an alarm or trouble state or other condition warranting communication of relevant information. In some embodiments, an audio sensor, for example comprising a microphone and associated logic circuitry, detects and recognizes when the smoke alarm detector is in an alarm state or trouble state based on sensing an the audible alarm sound that conventional smoke alarm detectors typically emit. Further, the retrofit apparatus can operate on battery power if a wired connection between the retrofit apparatus and the existing smoke alarm detector is unavailable or not desired for an installation scenario.

In some other example embodiments, a retrofit apparatus enables an existing, internal battery, self-powered powered smoke alarm detector to be retrofit with an adaptor ring apparatus that is configured for long-range wireless communications and physically positioned or sandwiched between the existing smoke alarm detector and its current base. For this type of internally powered smoke alarm detector configuration, the retrofit apparatus can contain circuitry, microprocessor logic, a conventional wireless communications device (for example, a cellular radiotelephone with a data communications channel) and an operational battery of sufficient capacity to independently power the unit for a minimum of six months, for example. The adapter ring apparatus can be configured to match the physical size and general layout of an existing detector housing and base. The adapter ring apparatus can further use similar and compatible rotating locking tabs to attach to both the base and the smoke alarm detector. The detector's existing battery connections, typically a receptacle capable of mating with a battery, can be connected with a wiring adapter of the retrofit apparatus to deliver electrical power from the adapter ring's battery to the detector. This wiring connection between the detector and adaptor ring can eliminate any need for installing an additional battery within the existing smoke alarm detector battery, as the power source for the adapter ring can be used to power the detector.

Some other example retrofit apparatus are configured with a housing that can enclose a conventional smoke alarm detector. One configuration of this housing comprises a cowling that fits over and encloses the detector. The physical construction and lay-out of such a cowling configuration can be distinct from a sandwich configuration of a ring-adaptor installation. For example, because the cowling can fit over the existing enclosure of the smoke alarm detector, while the example ring adaptor is installed within the existing enclosure of the detector, typically between the unit's base and the detector itself. The retrofit apparatus may contain circuitry, microprocessor logic, a conventional wireless communications device (for example, a cellular radiotelephone with a data communications channel), and an operational battery (internal power source) or a wiring adapter for connection to the existing connector or receptacle of the conventional detector (for external power, based on a connection to the detector's power source).

In some other example embodiments, a retrofit apparatus is configured as a base for use in situations where the existing smoke alarm detector is configured as a monolithic unit and may lack a separable mounting plate. The retrofit apparatus can contain circuitry, microprocessor logic, a conventional wireless communications device (for example, a cellular radiotelephone with a data communications channel), and an operational battery of sufficient capacity to independently power the unit for a minimum of six months. The retrofit apparatus can be configured to match the physical size and general layout of the surface of an existing monolithic detector that would mount to a ceiling or wall. Accordingly, such a retrofit apparatus can utilize similar and compatible attachment provisions, such as screw-holes or other appropriate fastening technology, to enable attaching the retrofit apparatus to the ceiling or wall, and then the smoke alarm detector to the retrofit apparatus. For a typical installation scenario, the retrofit apparatus can be connected to the monolithic smoke alarm detector housing. The retrofit apparatus can thus, in turn, be mounted to the ceiling or wall. The retrofit apparatus can serves as the base or mounting plate for the monolithic smoke alarm detector. The detector's existing battery connections, for example comprising a receptacle capable of mating with a battery, can be connected with a wiring adapter of the retrofit apparatus to deliver electrical power from the retrofit apparatus's battery to the detector. This wiring connection between the detector and retrofit apparatus can eliminate any need for installing an additional battery within the existing smoke alarm detector battery, because the power source for the adapter ring can be used to power the detector.

In some other example embodiments, a network of smoke alarm detectors can be installed at a premises, with the smoke alarm detectors communicating with one another. Further, at least one of the smoke alarm detectors can communicate information offsite. For example, one or more master smoke alarm detectors and one or more slave smoke alarm detectors can be installed at a common premises. The slave and master smoke alarm detectors can utilize like smoke alarm detectors outfitted with different adapter rings. In other words, the master and slave smoke alarms can be differentiated from one another according to how they are retrofitted. In some embodiments, the masters and slaves can communicate with one another via local, short-range wireless communication methods such as zwave, zigbee, Bluetooth infrared light, acoustic signals or other appropriate conventional short-range communications means. Meanwhile, the master or masters can communicate offsite using one or more long-range, wireless communications transceivers. Such a master/slave configuration can eliminate the cost of equipping every adapter ring apparatus at the premises with a long-range, wireless communications transceiver. For such an embodiment, a master adapter apparatus can be attached to a smoke alarm detector, and a slave adapter apparatus can be attached to each remaining smoke alarm detectors at the premise. The master adapter apparatus can be implemented by a retrofit apparatus containing logic circuitry, a microprocessor, a long-range wireless radio device comprising a data transceiver and a short-range wireless data device. One or more slave retrofit apparatus can be configured with logic circuitry, a microprocessor and a short-range wireless data device. The short-range wireless data device of each slave can communicate alarm event data and/or status information to the master and, in turn, the master can communicate the alarm event data and/or status information to a remotely located data collection site (for example a central monitoring station, intermediary server or recipient with compatible wireless data communications device) via the long-range wireless communications link.

In some example embodiments, the retrofit apparatus can operate in a constant powered-on state, and if power is lost, the apparatus can send a trouble signal or a low battery signal using long-range wireless communication as discussed above. The retrofit apparatus can be home-owner installed, using on-line activation to register the apparatus and activate the long-range wireless communication device, for example. Some example embodiments may include a sleep mode for conserving battery power. For example, a retrofit apparatus in sleep mode can be awakened by a trigger event, such as an alarm event, status event, or other event calling for communications activity.

In some example embodiments, a smoke alarm detector unit is combined with long-range wireless communications and a controller during initial manufacture to provide an integrated smoke alarm detector with long-range alarm event communications capability. As an alternative to the retrofit apparatus described above, the integrated smoke alarm detector can be manufactured with a built-in capability for communicating alarm event signals via an extended range, radio frequency communications link, such as a wireless transmitter or transceiver. Such an integrated smoke alarm detector can comprise conventional smoke, fire or other hazard detection and alarm circuitry and be configured to communicate an alarm detection event and, in certain scenarios, status information, to a remote monitoring site, intermediary collection and processing site, or a designated recipient (for example, an end user with a receiver, such as a so-called "smart" phone) via a long-range wireless communications link. The long-range wireless communications link can be implemented using a wireless data transceiver, for example a cellular radio-telephone with a data channel. The long-range wireless communications link can have an extended communications range capable of communicating a wireless signal over an extended distance that substantially exceeds short-range communications links having a limited range of fifty feet or less. A controller can be used for controlling the operations of both the detector and the communications device. The integrated smoke alarm detector may be housed within an enclosure that is typically configured for installation in a conventional manner in a conventional residence or business. The enclosure serves as the housing for the smoke alarm detector unit, the long-range wireless communications device, and the controller with supporting logic circuitry for controlling operations of the detector unit and the communications devices, for example. External or internal electrical power can be provided to power the smoke alarm detector unit, the long-range wireless communications device, and the controller and supporting logic circuitry. A suitable internal electrical power source is an operational battery of sufficient capacity to independently power the integrated unit for an extended period of time, such as for six months or more.

Technology for imparting alarm sensors with remote communication capabilities will now be described more fully with reference to FIGS. 1-11, which describe representative embodiments of the present technology. FIGS. 1, 2, 3, and 4 describe representative alarm networks incorporating wireless alarm sensors. FIGS. 5, 6, 7, 8, 9, 10, and 11 describe representative wireless alarm detectors, with FIGS. 5, 6, 7, 10, and 11 describing typical structures and forms and FIGS. 7 and 8 describing typical circuitry.

Turning now to FIG. 1, this figure illustrates a functional block diagram of a representative system 100 in which smoke alarm detectors 5 located at various premises 51 communicate with a cellular handheld device 75 through an intermediary server that also serves alarm panels 52 at other premises 51 according to some embodiments of the present technology.

The illustrated smoke alarm detectors 5 (also referred to as smoke detectors 5) serve as one non-limiting example of an alarm detector. Each of the smoke alarm detectors 5 has a capability for long-range wireless communication with a remote recipient via a wireless path 25, which may comprise a cellular system such as a commercial digital cellular telecommunications system. The descriptor "commercial" as applied to a digital cellular telecommunications system characterizes the digital cellular telecommunications system as supporting a commercial use, such as for providing for-pay service or otherwise for generating profit for example. As discussed in further detail below, among other places herein, the wireless communication capabilities of the smoke alarm detectors 5 may result from retrofitting (for example post-sale) or may be inherent from original manufacture.

In the illustrated embodiment, each smoke alarm detector 5 communicates directly with an intermediary server 76. The intermediary server 76 is offsite of each illustrated premises 51. The intermediary server 76 additionally serves alarm panels 52 that provide security alarm services at other premises 51. Accordingly, the illustrated intermediary server 76 can provide a gateway to varied alarm detectors and security systems that may be geographically dispersed. In example embodiments, the intermediary server 76 may comprise or be characterized as a middleware server.

The intermediary server 76, in turn, communicates with a central monitoring station 77, which may be remote from the intermediary server 76. However in some example embodiments, the intermediary server 76 is collocated with the central monitoring station 77. Thus, the central monitoring station 77 may comprise one or more intermediary servers 76 that provide connectivity to various alarm detectors and systems. The central monitoring station 77 typically provides monitoring services that may include human operators interacting with alarm panels 52 and users.

In the system 100, the intermediary server 76 links the smoke alarm detectors 5 and the alarm panels 52 with one or more cellular handheld devices 75, such as smartphones. Additionally, the central monitoring station 77 provides an alternate wireless connection path 25 to a cellular handheld device 75 of a user who may be an owner of one or more of the premises 51. Accordingly, via the system 100, each smoke alarm detector 5 communicates with monitoring entities including the intermediary server 76, the central monitoring station 77, and the cellular handheld 75.

Figure 2:
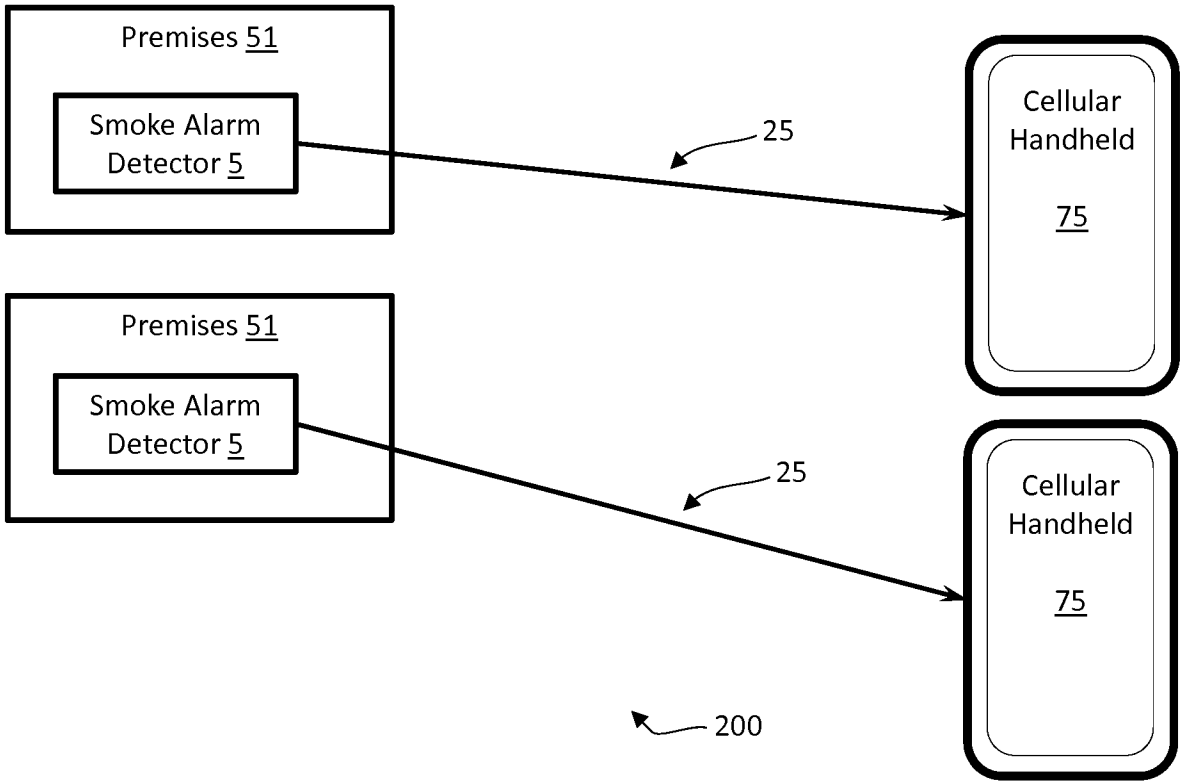
FIG. 2 is a functional block diagram of a system whereby smoke alarm detectors located at various premises communicate directly with a cellular handheld device, in accordance with some example embodiments of the present technology.

Turning now to FIG. 2, this figure illustrates a functional block diagram of an example system 200 in which smoke alarm detectors 5 located at various premises 51 communicate directly with respective cellular handheld devices according to some embodiments of the present technology. In the embodiment of FIG. 2, each smoke alarm detector 5 is retrofitted or originally manufactured to support off-premises communication using long-range wireless technology, such as via cellular communication.

In some embodiments, the system 200 illustrated in FIG. 2 may coexist with the system 100 illustrated in FIG. 1 and described above. Thus, the system 100 may comprise the system 200, or they may be supported by common communication network infrastructure, for example.

Figure 3:
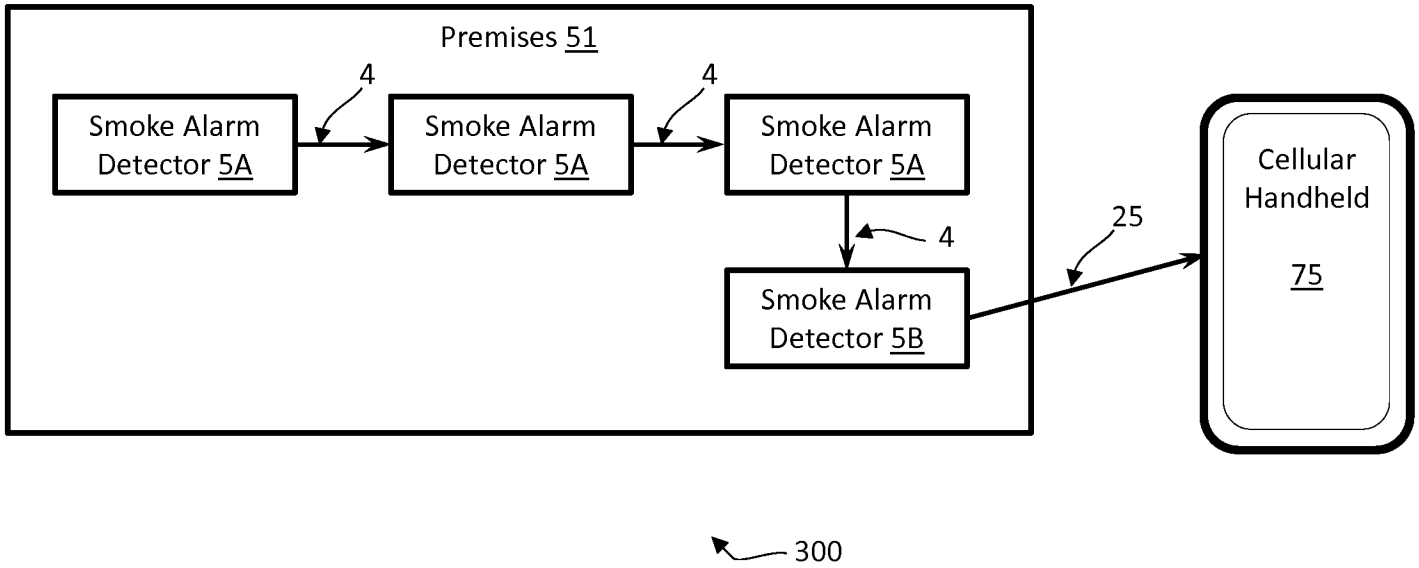
FIG. 3 is a functional block diagram of a network of smoke alarm detectors that are arranged in a series type topology at a common premises, whereby the smoke alarm detectors communicate with one another and one relays notifications offsite to a cellular handheld device, in accordance with some example embodiments of the present technology.

Turning now to FIG. 3, this figure illustrates a functional block diagram of an example network 300 of smoke alarm detectors 5A, 5B that are arranged in a series type topology at a common premises 51 according to some embodiments of the present technology. The smoke alarm detectors 5A communicate with one another and with the smoke alarm detector 5B using short-range wireless communication over the wireless path 4. The smoke alarm detector 5B supports off-premises communication, for example utilizing cellular technology over the wireless paths 25, with the cellular handheld 75 or some other appropriate remote recipient. The long-range communication capabilities of the smoke alarm detector 5B thus provide all the networked smoke alarm detectors 5A, 5B with a capability to communicate with the cellular handheld 75.

In a representative operation, one of the smoke alarm detectors 5A detects a smoke event and emits an audible alarm signal and a short-range radio frequency signal carrying an alarm notification. Another of the smoke alarm detectors 5A receives that alarm notification and passes the notification to a third of the smoke alarm detectors 5A. The third of the smoke alarm detectors passes the alarm notification to the smoke alarm detector 5B that has long-range communication capabilities. Additionally, the smoke alarm detector 5B can directly sense a smoke event itself and take action to issue local and remote alarm notifications. The smoke alarm detector 5B then transmits the notification to a remote monitoring entity. Bidirectional communication with the cellular handheld 75 (or some other remote entity) is likewise supported.

The communication capabilities of the smoke alarm detectors 5A and the smoke alarm detectors 5B are discussed in further detail below, among other places herein.

Figure 4:
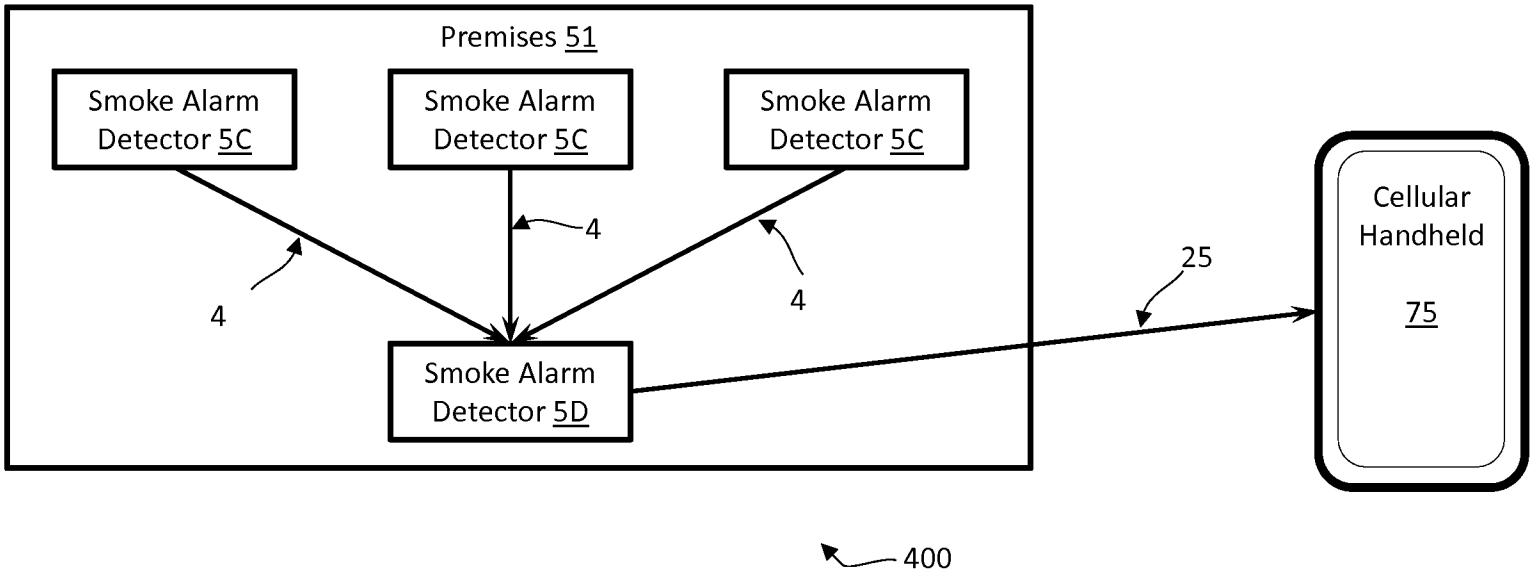
FIG. 4 is a functional block diagram of a network of smoke alarm detectors that are arranged in a parallel type topology at a common premises, whereby the smoke alarm detectors communicate with one another and one relays notifications offsite to a cellular handheld device, in accordance with some example embodiments of the present technology.

Turning now to FIG. 4, this figure illustrates a functional block diagram of an example network 400 of smoke alarm detectors that are arranged in a parallel type topology at a common premises 51 according to some embodiments of the present technology. The smoke alarm detectors 5C communicate with the smoke alarm detector 5D using short-range wireless communication over the wireless paths 4. The smoke alarm detector 5D supports off-premises communication, for example utilizing cellular technology over the wireless path 25, with the cellular handheld 75 or some other appropriate remote recipient. The long-range communication capabilities of the smoke alarm detector 5D thus provide all the networked smoke alarm detectors 5C, 5D with a capability to communicate with the cellular handheld 75.

In a representative operation, any one of the smoke alarm detectors 5C may detect a smoke event and emit an audible alarm signal and a short-range radio frequency signal carrying an alarm notification. The smoke alarm detector 5D receives the alarm notification from the issuing smoke alarm detector or detectors 5C. The smoke alarm detector 5D utilizes its long-range communication capabilities to transmit the notification to a remote monitoring entity. Additionally, the smoke alarm detector 5B can directly sense a smoke event itself and take action to issue local and remote alarm notifications. Bidirectional communication with the cellular handheld 75 (or some other remote entity) is likewise supported.

Figure 5:
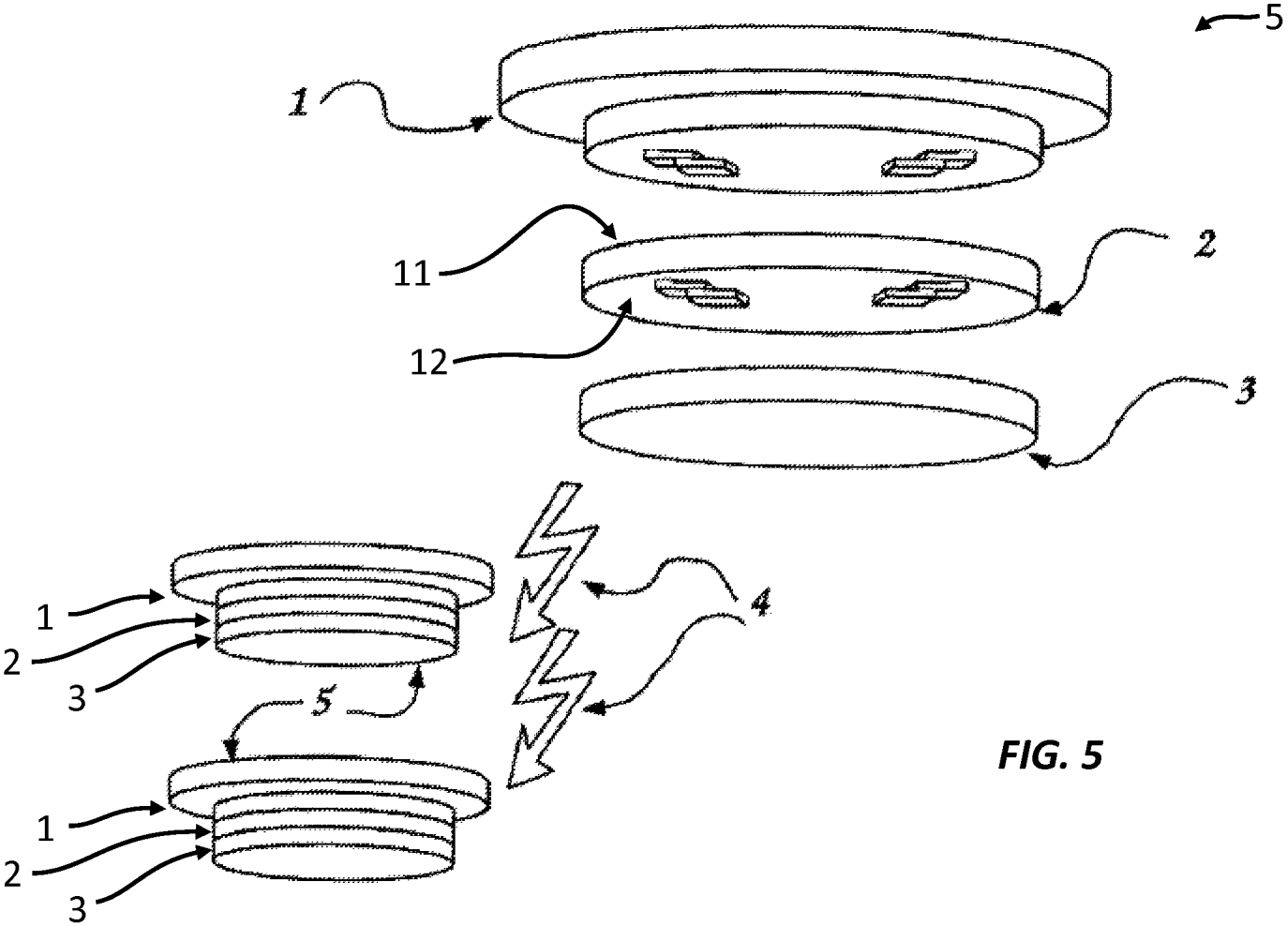
FIG. 5 is a diagram illustrating physical placement of an adapter ring apparatus within an existing smoke alarm detector, in accordance with some example embodiments of the present technology.

Turning now to FIGS. 5 through 8, example embodiments of smoke alarm detectors will be described in further detail. FIG. 5 depicts three example smoke alarm detectors 5, with the top right one shown in an exploded assembly view and in communication via short-range wireless signals 4 with the other two that are shown fully assembled. Each illustrated smoke alarm detector 5 may comprise the smoke detector 5A, 5B, 5C, or 5D, for example.

With respect to the top right smoke alarm detector 5, FIG. 5 illustrates an example smoke alarm detector 5 having wireless communication capabilities based on physical placement of an adapter ring apparatus 2 within an existing smoke alarm detector 3 and associated mounting plate 1. FIG. 5 further describes how the adapter ring apparatus 2 can be combined with an existing smoke alarm detector 3 to provide wireless communication.

The adapter ring apparatus 2 is one example of an embodiment of an adjunct module. The term "adjunct module," as used herein, generally refers to a module, device, system, or element that is added to a product after initial manufacture and sale of that product.

The mounting plate 1 or base serves as a ceiling or wall mount, while the smoke alarm detector 3 itself (i.e. the main unit) houses conventional smoke alarm detector elements, including smoke sensor, power facility, and alarm output. The adapter ring apparatus 2 houses logic circuitry, microprocessor logic, power supply circuitry, acoustic sensors, and a wireless communication system. As discussed in further detail below (and above), the wireless communication system can comprise one or both of low-power short-range communications equipment and long-range commercial wireless digital data telecommunications transceiver.

Figure 6A:
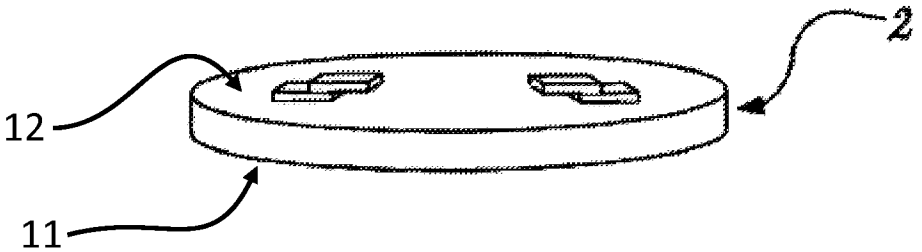
FIGS. 6A and 6B (collectively FIG. 6) is a diagram illustrating the mechanical fasteners on two sides of an adapter ring apparatus that facilitates mechanical interface with an existing smoke alarm detector, in accordance with some example embodiments of the present technology.
Figure 6B:
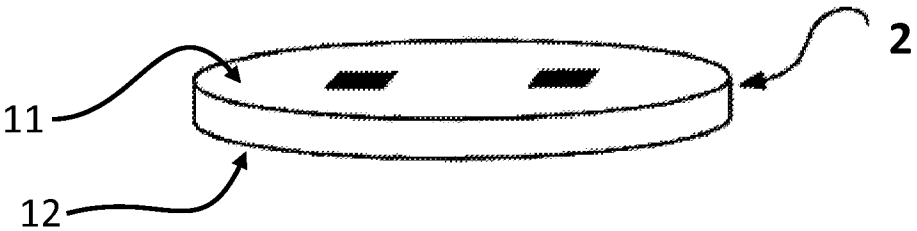

In a representative installation, the existing smoke alarm detector 3 is physically attached to the wall mounting plate 1 using a tab-and-slot arrangement, which is one example of mating. A typical tab-and-slot arrangement is illustrated in FIG. 6. FIG. 6A illustrates a top view of the side 12 of adapter ring apparatus 2 having tabs used to capture and physically lock to smoke alarm detector ceiling or wall mounting plate 1. FIG. 6B shows the reverse side 11 of adapter ring apparatus 2, wherein slots exist to capture the tabs of the smoke alarm detector 3. One side 11 of the adapter ring apparatus 2 emulates the side of the existing smoke alarm detector 3 that mates with the mounting plate 1, while the other side 12 of the adapter ring apparatus 2 emulates the side of the mounting plate 1 that mates with the existing smoke alarm detector 3. Thus, the adapter ring apparatus mates with the existing smoke alarm detector 3 as well as the mounting plate 1 to provide a sandwich configuration. Accordingly, in an example embodiment, a retrofit portion of the smoke alarm detector 5 joins with a legacy portion of the smoke alarm detector 5 via at least one receptacle.

A typical existing smoke alarm detector 3 will also have electrical interconnections between the smoke alarm detector 3 and smoke alarm detector ceiling or wall mounting plate 1 providing power transfer from a power source fed through the ceiling or wall to smoke alarm detector ceiling or wall mounting plate 1. Typical electrical interconnections may be in the form of discrete wire connections or a plug and jack connector arrangement, depending upon they brand of smoke alarm detector. Such electrical interconnections are not illustrated in FIGS. 5 and 6, but those skilled in the art having benefit of this disclosure will appreciate that compatible connections and, or plug/jack type connectors are readily and economically equipped and would be altered based upon the brand and/or model of existing smoke alarm detector involved in a given installation.

In a retrofit for a representative installation, the existing smoke alarm detector 3 is twisted to release and separate the existing smoke alarm detector 3 from the mating smoke alarm detector ceiling or wall mounting plate 1. Once the separation has been completed, the retrofit proceeds with insertion of the adapter ring apparatus 2 between smoke alarm detector ceiling or wall mounting plate 1 and smoke alarm detector 3. Electrical wiring, if applicable, is interconnected between smoke alarm detector ceiling or wall mounting plate 1 adapter ring apparatus 2 and smoke alarm detector 3. Finally, each section, in turn, is aligned and twisted until all three are locked by via their fastening tabs into an integrated unit.

The term "integrated," as used herein, generally refers to united, combined, brought together, included, or joined.

Multiple smoke alarm detectors 5 disposed at one premises 51 can be similarly retrofitted with an adapter ring apparatus 2 in the manner described above. Such smoke alarm detectors 5 may be each equipped to operate independently or they can be slaved via short range wireless signals 4, for example using low power radio, sound waves, or infrared light.

Some example embodiments of circuitry for smoke alarm detectors 5 will now be discussed with reference to FIGS. 6 and 7, which illustrate functional block diagrams. In this discussion, the smoke alarm detector 5 may embody one or more of the smoke alarm detectors 5A, 5B, 5C, and 5D as illustrated in FIGS. 3 and 4 and discussed above.

Some installations of existing smoke alarm detector 3 will be powered by commercial alternating current ("AC") power, while others use low-voltage power, such as 12-volts direct current ("DC").

Figure 7:
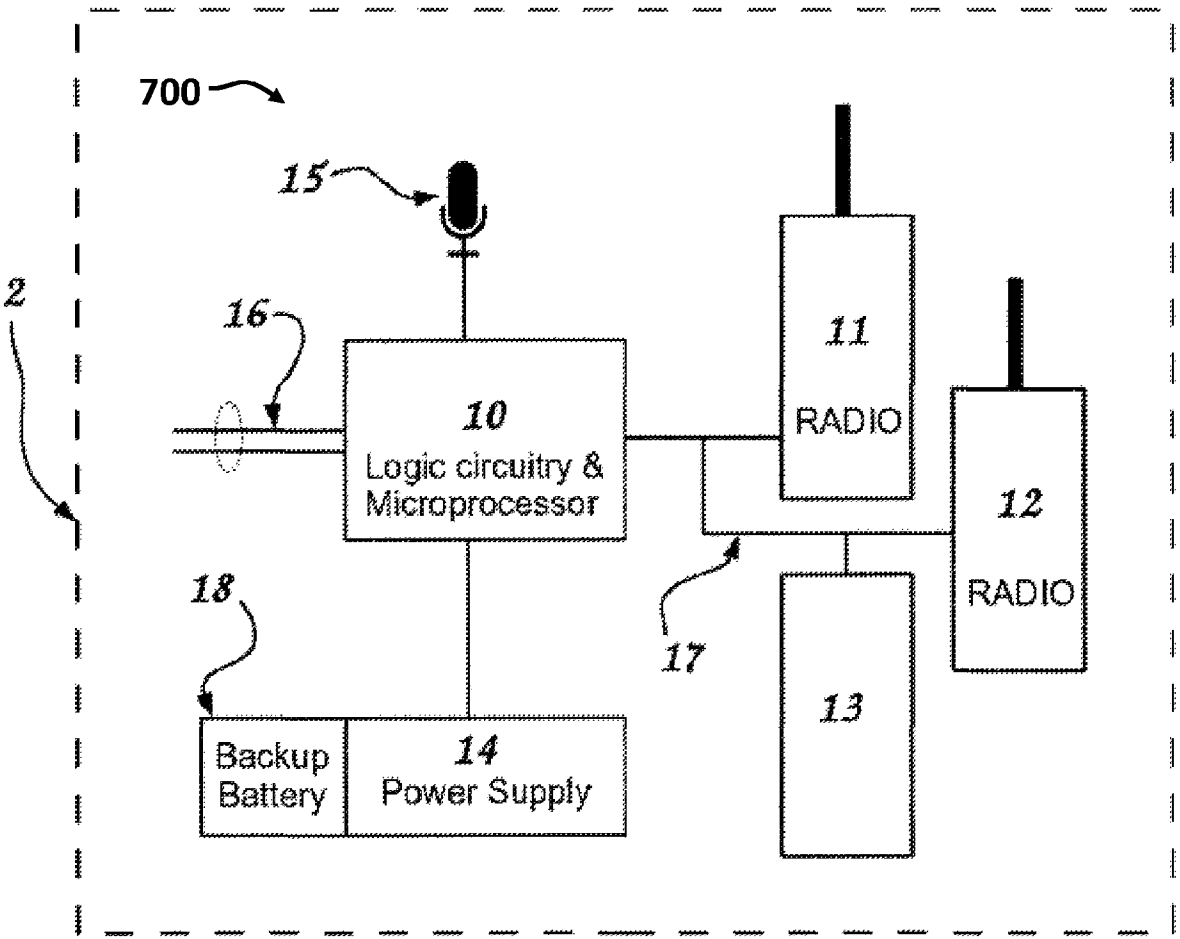
FIG. 7 is a schematic of internal circuitry of an externally powered adapter ring apparatus, in accordance with some example embodiments of the technology.

FIG. 7 illustrates, in schematic form, representative internal circuitry 700 of an externally powered adapter ring apparatus 2. In the embodiment of FIG. 7, a power supply 14 is configurable to convert either commercial AC or low-voltage power to a voltage and type consumed by elements of the adapter ring apparatus 2. Electrical power and/or electrical communication is further supported by the wiring connections 17. The electrical power feeds a microprocessor 10 and radios 11 and 12 and/or local wireless communication module 13 plus a microphone 15.

The radio 11, the radio 12, the microphone, and the wireless communication module 13 may have redundant roles in some embodiments of the adapter ring apparatus 2. Some embodiments of the adapter ring apparatus 2 may incorporate a subset of the radio 11, the radio 12, the microphone, and the wireless communication module 13. One or both of the radios 11, 12 can be utilized for local communication, for example with a master or slave smoke alarm detector 5 or some other smoke alarm detector 5 at a common premises 51, for example. One or both of the radios 11, 12 can be utilized for remote communication, for example with an offsite monitoring entity via cellular communications, for example. One or both of the radios 11, 12 may comprise a transceiver, for example. One or both of the radios 11, 12 may comprise a near field radio, for example.

The microphone 15 detects the acoustic alarm of smoke alarm detector 5 in situations where access where alarm outputs, such as relay contacts, do not exist for the type of smoke alarm detector 3 of said existing installation, and thus wired connections are not readily available. In representative operation of some example embodiments, the adapter ring apparatus 2 can use the wired connection 16 to the smoke alarm detector 3.

When some existing smoke alarm detectors 3 transition to an alarm state, a normally open contact of the smoke alarm detector 3 changes from open to closed state (or vice versa). For example, a mechanical or solid state switch on the existing alarm detector 4 may open or close. The wired connection to the existing smoke alarm detector can probe such a contact or switch to sense when a smoke event has been detected.

Alternatively, some existing smoke alarm detectors 3 may emit an audible alarm when in an alarm condition rather than opening or shutting a switch. The microphone 15 can sense such an alarm sound emitted from the existing alarm detector 3 to identify a smoke event or other alarm condition.

In some embodiments, the microphone 15 can comprise, be supplemented with, or be replaced by a light sensor that detects light pulses (visible or near infrared "NIR") emitted by the existing smoke alarm detector 3 according to alarm state and/or device status.

A near field radio may also be utilized for communication between the existing alarm detector and the adapter ring apparatus 2. Accordingly, in some embodiments, a connection can be made with a near field radio or an audio microphone sensor 15 and associated logic circuitry and microprocessor logic 10 to detect and recognize when the existing smoke alarm detector 3 is in an alarm or trouble state.

As will be appreciated by those of skill in the art having benefit of this disclosure, such a near field radio can practice near field communications "NFC," which can be used in industry for smartphones, NFC chips, tags, and other devices to establish radio communications with one another when they are within a few inches of touching.

When the logic circuitry and microprocessor logic 10 detect that the smoke alarm detector is in an alarm or trouble state, the adapter ring apparatus 2 sends a notification message to one or more remote destinations via commercial wireless digital data telecommunications channels using wireless digital data radio 11, which can comprise a transceiver. The term "transceiver," as used herein, refers to a transmitter and a receiver that are disposed in or on a common housing.

Representative remote destinations include a central or remote monitoring station, an intermediary data collection and processing site, which may be implemented as an intermediary server, or a recipient with a compatible communications device, for example.

For communications with a recipient, if an alarm event or status item is detected, the adapter ring apparatus 2 (which is an example of a retrofit unit) may contact the recipient or end user directly or forward information to the remote monitoring station or intermediary data collection and processing site. If the recipient is contacted directly, the message may be sent to the recipient via a long-range wireless communications network in the form of a Short Message Service ("SMS") or data connection over commercially available wireless communication service's data channels, including but not limited, to General Packet Radio Service ("GPRS"), IXRTT, DCEV-DO, IXMC, 3XMC or WCDMA, for example. Further, if an event is reported by the adapter ring apparatus 2 to the remote monitoring station, a reporting notification may subsequently be forwarded to the end user or consumer using one or more of the aforementioned commercially available wireless data services.

In some example embodiments, the adapter ring apparatus 2 is always operating, and if power is lost, adapter ring apparatus 2 sends a low-battery trouble signal to predetermined remote destinations via commercial wireless digital data telecommunications channels using wireless digital data transceiver 11.

Figure 8:
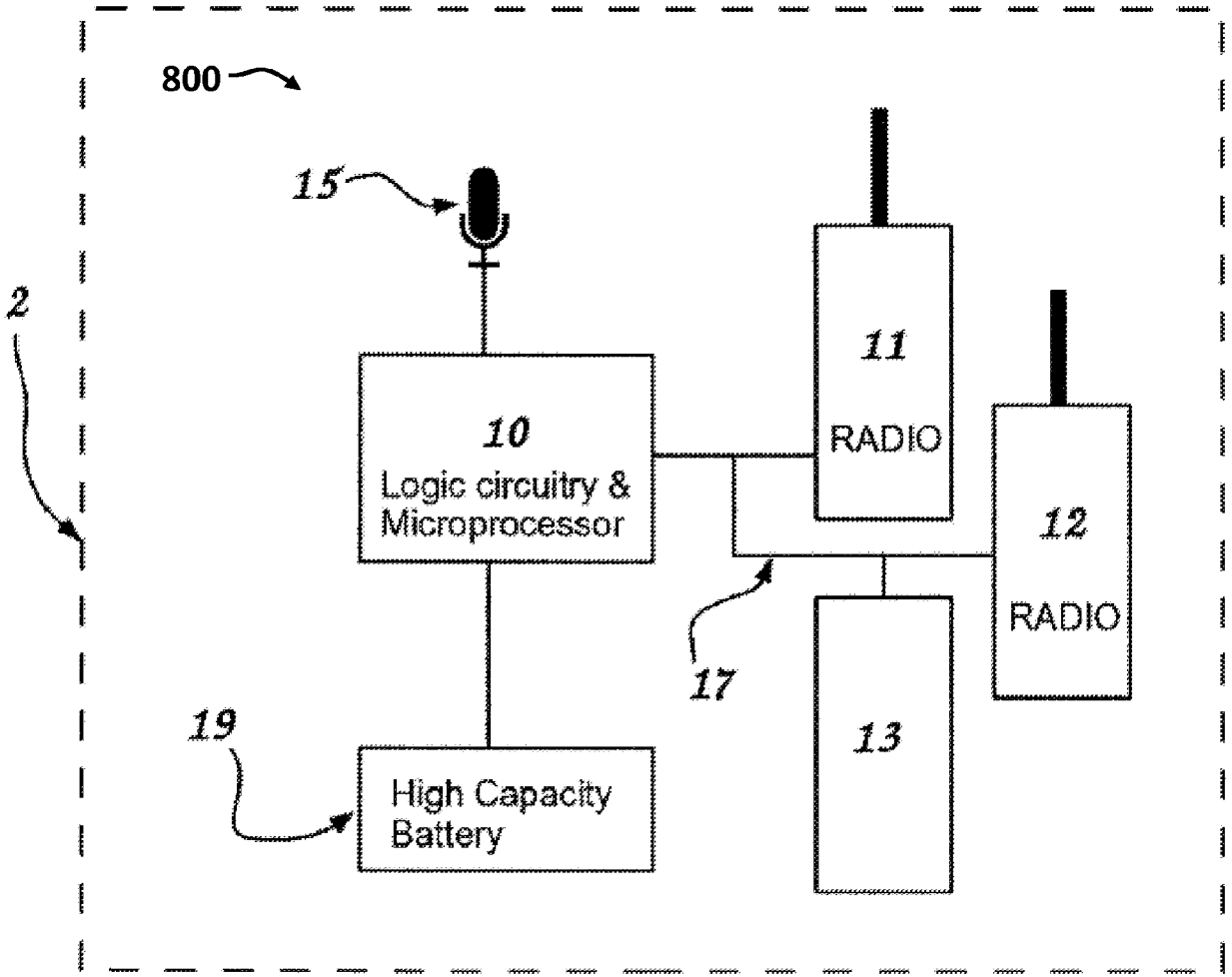
FIG. 8 is a schematic of internal circuitry of an internally powered adapter ring apparatus, in accordance with some example embodiments of the present technology.

As illustrated in FIG. 8, some example embodiments of the adapter ring apparatus 2 can exclusively utilize internal power from a high capacity battery 19 or other energy storage unit. Accordingly, the circuitry 800 of the adapter ring apparatus embodiment of FIG. 8 offers one alternative to the circuitry 700 illustrated in FIG. 7 and discussed above. In some example embodiments, a smoke alarm detector 3 is retrofitted with a version of the adapter ring apparatus 2 that operates from an internal battery 19 of sufficient capacity to power the adapter ring apparatus 2 for at least six months in typical operating conditions, for example. However, longer or shorter operating durations may be utilized. In some configurations, the high capacity internal battery 19 will power the retrofitted smoke alarm detector 3 in addition to the adapter ring apparatus 2. If battery capacity drops below a predetermined level, the adapter ring apparatus 2 can send a low-battery trouble signal to one or more predetermined remote destinations via one or more commercial wireless digital data telecommunications channels using the radio 11 as a wireless digital data transceiver, for example.

The functional capabilities of the circuitry 700 illustrated in FIG. 7 and the circuitry 800 illustrated in FIG. 8 supports networking multiple retrofitted smoke alarm detectors 2 to one another as discussed above with reference to FIGS. 3 and 4, inter alia. Some embodiments of such networking utilize a master/slave configuration, for example.

A master/slave configuration can utilize a single master adapter ring apparatus 3 having long-range and short-range wireless communications capability and one or more slave adapter ring apparatus 3 with short-range wireless communications capability. Each slave adapter apparatus 3 is installed within the same premise and can be slaved to a master adapter ring apparatus using local, short-range wireless communication methods, such as zwave, zigbee, Bluetooth infrared light, acoustic signals or other appropriate known communication technology. Short-range wireless communications for the master adapter ring apparatus 3 and the slave ring adapters 3 can be implemented by a short-range wireless radio transceiver 12 or infrared light, acoustic signals or other means using the wireless communication module 13 as a local communicator, for example. Unlike the slaves, the master typically includes a long-range, wireless communications transceiver or transmitter for communication of alarm event or status information obtained from a slave to a remote destination or recipient. This master/slave configuration eliminates the cost of equipping every adapter ring apparatus 2 in the premises 51 with a long-range, wireless communications transceiver or transmitter.

In some example master/slave embodiments, a master adapter ring apparatus 2 is attached to a smoke alarm detector 3, and a slave adapter ring apparatus 2 is attached to each of the remaining smoke alarm detectors 3 within a premise 51. The master adapter ring apparatus 2 is implemented using logic circuitry, a microprocessor, a long-range wireless radio device comprising a data transceiver and a short-range wireless data device. One or more slave adapter ring apparatus 2 are configured with logic circuitry, a microprocessor and a short-range wireless data device. The short-range wireless data device of each slave adapter ring apparatus 2 can communicate alarm event data and/or status information to the master and, in turn, the master can communicate the alarm event data and/or status information to a remotely located data collection site (central monitoring station, intermediary server or recipient with compatible wireless data communications device) via the long-range wireless communications link.

Figure 9:
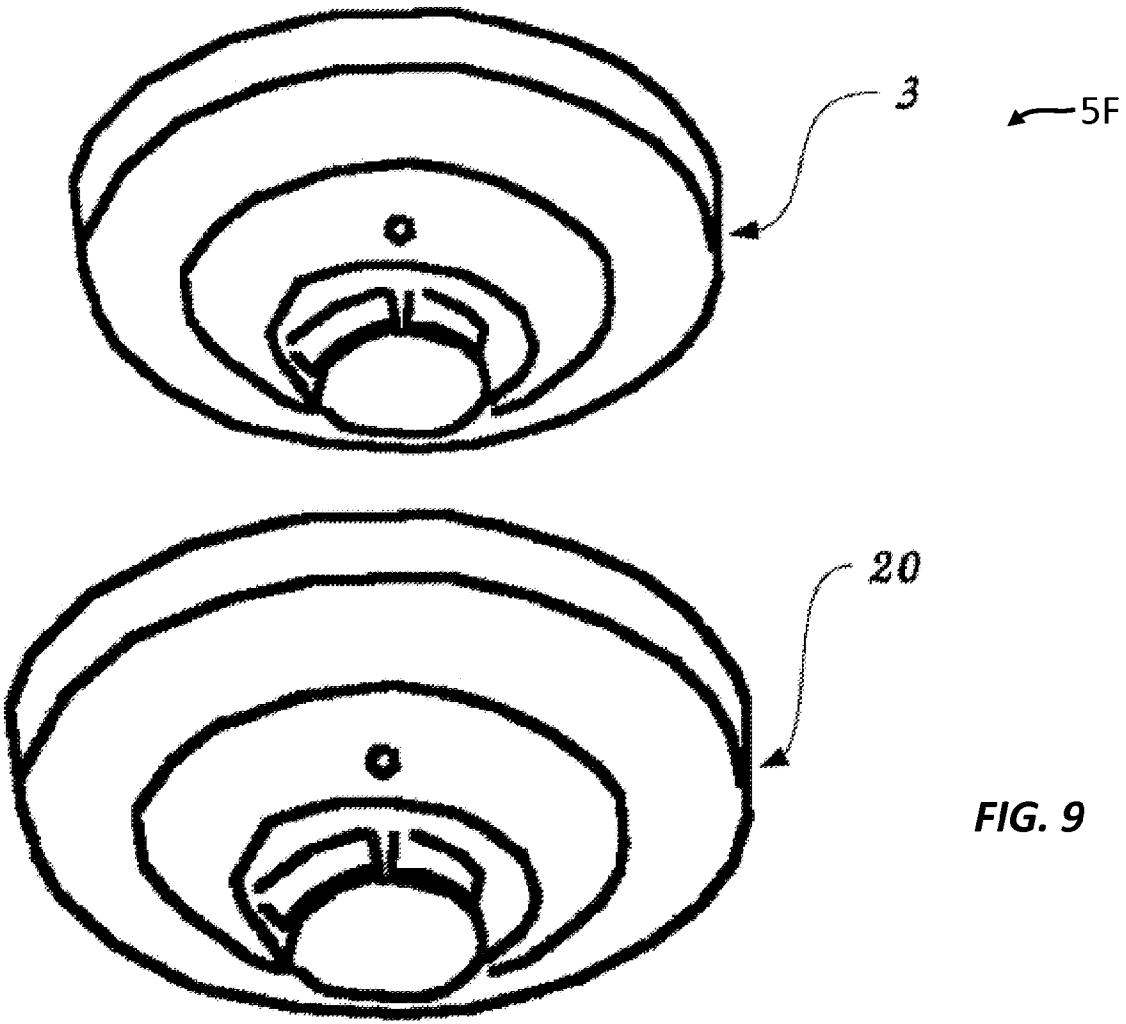
FIG. 9 is a diagram illustrating a cowling configuration for wireless communications retrofit of an existing smoke alarm detector, in accordance with some example embodiments of the present technology.

Turning now to FIG. 9, this figure illustrates an example cowling configuration for wireless communications retrofit of an existing smoke alarm detector 3 according to some embodiments. As shown in FIG. 9, in some embodiments, the legacy smoke alarm detector 3 is not equipped with a separate ceiling or wall mount with tabs, and thus may be directly fastened to a ceiling, wall, or other surface. In such case, a version of retrofit apparatus may be functionally equivalent to the above described adapter ring apparatus 2 of FIGS. 5 to 8, but is physically configured as a cowling that is snapped over the existing smoke alarm detector 3 and may encapsulate it. More generally, the retrofitted smoke alarm detector 5F comprises a legacy smoke alarm detector 3 and an adapter ring apparatus 20 comprising a receptacle that couples to the legacy smoke alarm detector 3. Other than the means of attachment, functional aspects of retrofit apparatus 20 can be consistent with the adapter ring apparatus 2 described above.

Figure 10:
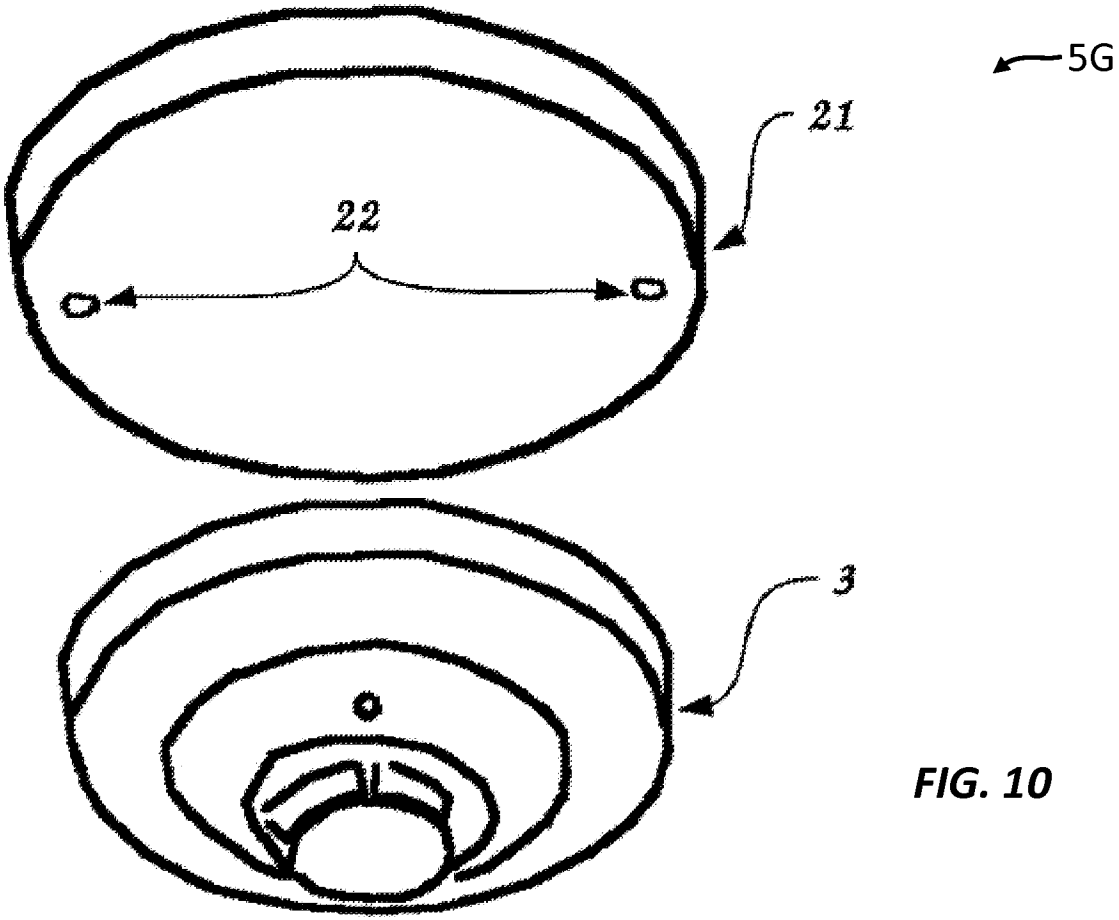
FIG. 10 is a diagram illustrating a retrofit apparatus comprising a base which connects to an existing smoke alarm detector that is configured as a monolithic unit, lacking a separable mounting plate, in accordance with some example embodiments of the present technology.

Turning now to FIG. 10, this figure illustrates an example retrofit apparatus comprising a base 21 which connects to an existing smoke alarm detector 3 that is configured as a monolithic unit, lacking a separable mounting plate, in accordance with some example embodiments of the present technology. More specifically, FIG. 10 illustrates an example retrofit apparatus 21 that is configured to serve as a base for situations where the existing smoke alarm detector 3 is a monolithic unit and lacks a separable mounting plate. The term "monolithic," as used herein, generally refers to something that is housed in a common enclosure or that is otherwise configured as a single unit.

The retrofit apparatus 21 typically contains circuitry, microprocessor logic, a conventional wireless communications device (for example, a cellular radiotelephone with a data communications channel) and an operational battery of sufficient capacity to independently power the unit for a minimum of six months. The retrofit apparatus 21 can comprise the circuitry 700 and 800 illustrated FIGS. 7 and 8 respectively and discussed above, for example.

The retrofit apparatus 21 is typically configured to match the physical size and general layout of the surface of an existing monolithic detector 3 that would mount to a ceiling or wall and can use similar and compatible attachment means, such as screw-holes 22, to facilitate attaching the retrofit apparatus 21 to the ceiling or wall and then the smoke alarm detector 3 to the retrofit apparatus. The detector's existing battery connections, typically a receptacle capable of mating with a battery, can be connected with a wiring adapter of the retrofit apparatus 21 to deliver electrical power from the retrofit apparatus's battery to the smoke alarm detector 3. This wiring connection between the smoke alarm detector 3 and the retrofit apparatus 21 can eliminate a need for installing an additional battery within the existing smoke alarm detector battery as the power source for the retrofit apparatus 21 can power the smoke alarm detector 3.

Figure 11:
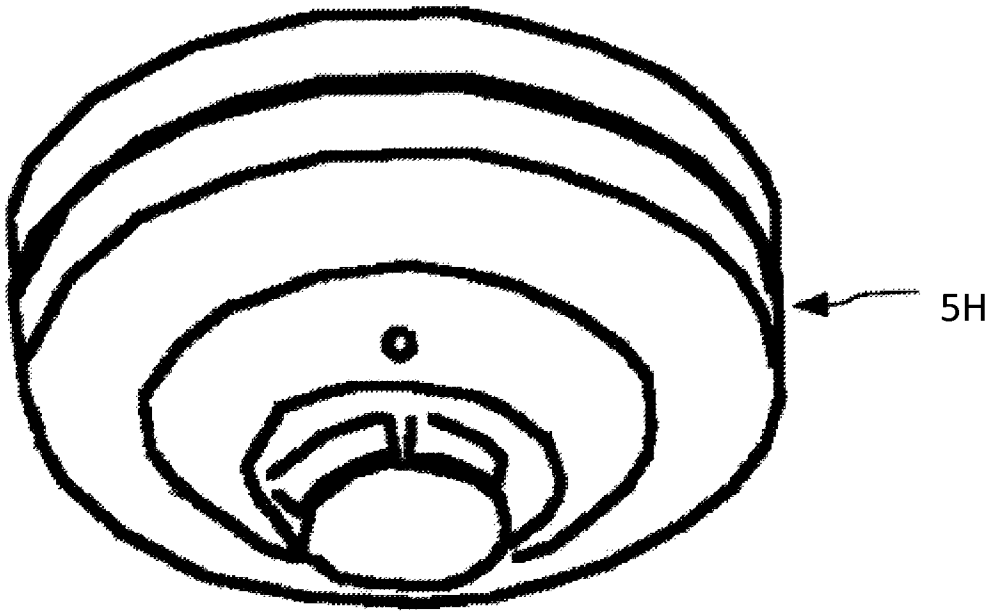
FIG. 11 is a diagram illustrating a smoke alarm detector unit originally manufactured to include long-range wireless communications and a controller, to provide long-range alarm event communications capability, in accordance with some example embodiments of the present technology.

Turning now to FIG. 11, this figure illustrates a smoke alarm detector unit originally manufactured to include long-range wireless communications and a controller, to provide long-range alarm event communications capability, in accordance with some example embodiments of the present technology. In the smoke alarm detector 5H of FIG. 11, a smoke alarm detector unit is combined with long-range wireless communications and a controller to provide long-range alarm event communications capability. The smoke alarm detector 5H comprises a smoke, fire, gas or other hazard detector, a wireless data transceiver, such as a cellular radiotelephone with a data channel, and a controller with supporting logic circuitry for controlling operations of the detector and the transceiver. The wireless data transceiver may have an extended communications range that is capable of communicating a wireless signal over an extended distance that far exceeds short-range communications links having a limited range, usually proximate to the transmitter and within 100 meters or less.

In contrast to the retrofit apparatus described above, the smoke alarm detector 5H is manufactured with a built-in capability for communicating alarm event signals via an extended range, radio frequency communications link, such as a wireless transmitter or transceiver. This smoke alarm detector 5H comprises conventional smoke, fire or other hazard detection and alarm circuitry and is configured to communicate an alarm detection event and, in certain scenarios, status information, to a remote monitoring site, intermediary collection and processing site, or a designated recipient (for example, an end user with a receiver, such as a so-called "smart" phone) via a long-range wireless communications link. is useful for controlling the operations of both the detector and the communications device.

The smoke alarm detector 5H can be housed within an enclosure that is configured for installation in a conventional manner in a conventional residence or business, for example. The enclosure serves as the housing for the smoke alarm detector unit, the long-range wireless communications device and the controller with supporting logic circuitry for controlling operations of the detector unit and the communications devices, for example. External or internal electrical power is provided to power the unit, the long-range wireless communications device and the controller and supporting logic circuitry. A typical internal electrical power source may be an operational battery of sufficient capacity to independently power the integrated unit for an extended period of six months.

The various smoke alarm detector embodiments discussed above with respect to FIGS. 1-11, inter alia, may be distributed or sold in various manners known in the art, either in the form of a retrofit kit or as a product originally manufactured with remote communication capabilities. Whether the product comprises a retrofit kit or a unit having original remote communication capabilities, the product may be sold in a blister-pack-type package at a retail outlet for purchase by consumers. The consumer may install the retrofit apparatus or integrated smoke alarm detector in any interior location, including, but not limited to, a home or an office. For certain embodiments, these products can be purchased with an escrowed long-range wireless data communications service, and no additional billing arrangements or contracts with a service provider are necessary for the long-range wireless communications.

In some example embodiments, the products can be distributed in accordance with any of the teachings or disclosure of U.S. Pat. No. 8,265,605, entitled "Service Escrowed Transportable Wireless Event Reporting System," filed Feb. 6, 2008 and issued Sep. 11, 2012 in the name of Michael A. Marett and Edward I. Comer, the entire contents of which are hereby incorporated herein by reference.

For example, for a representative installation, the consumer may proceed to set up an example retrofit apparatus or example integrated smoke alarm detector in a desired location. Upon completing device setup, the consumer may initialize the device through interactions with the controller. For example, upon powering up, the controller may instruct the long-range wireless communications device to contact a remote monitoring station or other third-party host server over the extended range wireless communications network. The controller may convey its identity to the remote monitoring station so that the escrowed service pre-associated with that identity may be activated for communications activities. The consumer may support initialization activities by using a computer, smart phone or other networked communication device to interact via the Internet with a website associated with the device. The website information is typically provided with the installation literature for the device, and may be provided on the packaging or housing for the device. An example website typically prompts the consumer to enter certain initialization information, including but not limited to, an identification for processing remote commands received from the consumer (e.g., a code that may be found with the packaging for the system or created by the system) and information for directly reporting an alarm event or status information to the consumer (e.g., a mobile device number). Also, the consumer may also, via on-line interactions, a preferred mechanism for receive event information, for example, a telephone number to be called for synthesized voice reporting or an SMS message or an email address for reporting event information as text.

Technology for alarm sensors has been disclosed, including various embodiments as follows without limitation.

Example embodiments of a method are disclosed. The example method can comprise: generating an alarm signal at a first alarm detector disposed at a premises in response to the first alarm detector detecting an alarm event; wirelessly sending the alarm signal from the first alarm detector to a second alarm detector disposed at the premises; responsive to receiving the alarm signal at the second alarm detector, wirelessly sending the alarm signal from the second alarm detector to a third alarm detector disposed at the premises; and responsive to receiving the alarm signal at the third alarm detector, wirelessly sending the alarm signal from the third alarm detector for receipt at a cellular handheld device disposed remotely with respect to the premises.

In some example embodiments of this method, the first alarm detector, the second alarm detector, and the third alarm detector communicate with one another via a short-range wireless connection, and the third alarm detector communicates with the cellular handheld device over a cellular communication network.

In some example embodiments of this method, the third alarm detector communicates with the cellular handheld device through an intermediary server that links alarm detectors and alarm panels at geographically diverse premises to one or more central monitoring stations.

In some example embodiments of this method, the first alarm detector comprises a first smoke detector, the second alarm detector comprises a second smoke detector, and the third alarm detector comprises a third smoke detector. Additionally, in some example embodiments, the first smoke detector is retrofitted to support short-range wireless communication, the second smoke detector is retrofitted to support short-range wireless communication, and the third smoke detector is retrofitted to support communication over a cellular communication network.

Example embodiments of an alarm detector are also disclosed. The alarm detector can comprise: a sensor operative to sense an alarm event and produce a corresponding alarm notification; a short-range wireless receiver operative to receive short-range wireless signals conveying alarm notifications from a plurality of other alarm detectors that are disposed locally; and a long-range wireless transmitter operative to transmit the corresponding alarm notification and the conveyed alarm notifications over a cellular network.

In some example embodiments of this alarm detector, transmitting the corresponding alarm notification and the conveyed alarm notifications over the cellular network comprises: transmitting an alert over the cellular network in response to the corresponding alarm notification being produced; or transmitting the alert over the cellular network in response to one or more of the alarm notifications being conveyed from one or more of the plurality of other alarm detectors.

In some example embodiments of this alarm detector, the sensor comprises a smoke sensor, and the other alarm detectors comprise other smoke sensors.

In some example embodiments of this alarm detector, a legacy portion of the alarm detector comprises the sensor, and a retrofit portion of the alarm detector comprises the short-range wireless receiver and the long-range wireless transmitter.

In some example embodiments of this alarm detector, the short-range wireless receiver comprises a microphone, the corresponding alarm notification comprises an electrical signal, and the short-range wireless signal comprise sound.

Example embodiments of a retrofit kit are also disclosed. The retrofit kit can comprise: a housing that mates with the smoke detector; a sensor that is mounted to the housing and that is operative to sense when the smoke detector has detected a smoke event and provide an electrical signal when the smoke event is detected; and a cellular radio that is mounted to the housing, that is electrically coupled to the sensor, and that is operative to emit a cellular signal in response to receiving the electrical signal.

In some example embodiments of this retrofit kit, the sensor comprises a microphone for detecting the smoke event based on sensing sound waves produced by the smoke detector.

In some example embodiments of this retrofit kit, the smoke detector comprises a contact that changes state when the smoke detector detects the smoke event, and the sensor comprises an electrical source and an associated electrical lead for connecting to the contact to sense the smoke event based on determining the state of the contact.

In some example embodiments of this retrofit kit, the retrofit kit further comprises a short-range radio receiver that is operative to receive radio frequency alarm signals from another smoke detector disposed locally, and the cellular radio is operative to communicate with a cellular handheld device via a cellular network.

In some example embodiments of this retrofit kit, the retrofit kit further comprises a short-range radio receiver that is operative to receive radio frequency alarm signals from a plurality of other smoke detectors disposed proximate to the smoke detector.

In some example embodiments of this retrofit kit, the smoke detector comprises a member for mounting to a surface of a building and a unit that mounts to the member and that houses a smoke sensor, and the housing of the retrofit kit comprises a first side that connects to the member and a second side that connects to the unit.

Example embodiments are also disclosed of a kit for upgrading an alarm detector from providing a local alarm notification to providing a remote alarm notification. The kit can comprise: a housing that mates with the alarm detector via a receptacle; a sensor attached to the housing, the sensor operable to receive a signal from the alarm detector indicative of an occurrence of the local alarm notification and to produce an electrical signal responsive to receipt of the signal; and a radio attached to the housing and electrically connected to the sensor, the radio operative to send the remote alarm notification to a remote recipient via a cellular network responsive to the sensor producing the electrical signal.

In some example embodiments of this kit, the alarm detector comprises a smoke alarm, the remote recipient comprises a handheld cellular device, and sending the remote alarm notification to the remote recipient via the cellular network comprises: transmitting the remote alarm notification to an intermediary server (which may be characterized as an intermediary server) via the cellular network; and transmitting the remote alarm notification from the intermediary server to handheld cellular device.

In some example embodiments of this kit, the local alarm notification comprises an audible local alarm notification, the sensor comprises a microphone that is operable to detect the audible local alarm notification, the receptacle of the housing is sized to fit over the alarm detector, the kit comprises a radio frequency receiver that is attached to the housing, the radio frequency receiver is operative to receive wireless signals from other alarm detectors disposed locally, and the radio is operative to send the remote alarm notification to the remote recipient in response to the radio frequency receiver receiving at least one of the wireless signals from the other alarm detectors that are disposed locally.

In some example embodiments of this kit, the local alarm notification comprises an audible sound, and the sensor comprises a microphone system capable of discriminating the audible sound of the local alarm notification from other audible sounds.

From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the example embodiments, equivalents of the elements shown therein will suggest themselves to those skilled in the art, and ways of constructing other embodiments of the present technology will appear to practitioners of the art.

What is claimed is:

1. A method comprising:

changing a state of a contact at an alarm detector disposed at a premises in response to the alarm detector detecting an alarm event;

providing an alarm signal for the alarm event by sensing the state change of the contact using an electrical source connected to the contact; and wirelessly communicating the alarm signal from the alarm detector to a monitoring entity remotely located with respect to the premises.

2. The method of claim 1, wherein the monitoring entity comprises a smartphone.

3. The method of claim 1, wherein communicating the alarm signal from the alarm detector to the monitoring entity remotely located with respect to the premises comprises conveying long-range wireless signals over a commercial digital cellular telecommunications system.

4. The method of claim 3, wherein a monolithically integrated digital cellular telecommunications transceiver communicates the long-range wireless signals from the alarm detector.

5. The method of claim 3, wherein an adjunct module communicates the long-range wireless signals from the alarm detector.

6. The method of claim 1, wherein the alarm detector disposed at the premises communicates with the monitoring entity remotely located with respect to the premises through an intermediary server that links alarm detectors and alarm panels at geographically diverse premises to one or more central monitoring stations.

7. The method of claim 1, wherein the alarm detector comprises a smoke detector.

8. A method comprising:

generating an alarm signal at a first alarm detector that is disposed at a premises in response to detection of an alarm event by any of a plurality of other alarm detectors that are disposed at the premises; and wirelessly communicating the alarm signal from the first alarm detector to a monitoring entity remotely located with respect to the premises, wherein the first alarm detector comprises:

a contact that changes state when the first alarm detector detects a smoke event; and an electrical source that is connected to the contact via an electrical lead to detect the smoke event based on determining the state of the contact for sending a wireless notification of the smoke event from the first alarm detector to the monitoring entity.

9. The method of claim 8, wherein the monitoring is entity remotely located with respect to the premises comprises a smartphone.

10. The method of claim 8, wherein wirelessly communicating the alarm signal from the first alarm detector to the monitoring entity remotely located with respect to the premises comprises conveying long-range wireless signals over a commercial digital cellular telecommunications system.

11. The method of claim 8, wherein the alarm signal transmits wirelessly from one or more of the plurality of other alarm detectors to the first alarm detector to trigger said wirelessly communicating the alarm signal from the first alarm detector to the monitoring entity.

12. The method of claim 8, wherein the first alarm detector and the plurality of other alarm detectors communicate with one another about the alarm event via a short-range wireless connection, and wherein the first alarm detector communicates with the monitoring entity disposed remotely with respect to the premises via long-range wireless signals over one or more commercial digital cellular telecommunications systems.

13. The method of claim 12, wherein the short-range wireless connection comprises a low-power monolithically integrated radio telecommunications transceiver.

14. The method of claim 12, wherein the short-range wireless connection comprises a low-power radio telecommunications transceiver adjunct integrated module.

15. The method of claim 12, wherein the short-range wireless connection comprises a low-power infrared light transceiver adjunct integrated module.

16. The method of claim 12, wherein the short-range wireless connection comprises a low-power monolithically integrated infrared light transceiver.

17. The method of claim 12, wherein the long-range wireless signals communicated by the first alarm detector utilize a monolithically integrated radio telecommunications transceiver.

18. The method of claim 12, wherein the long-range wireless signals communicated by the first alarm detector utilize a radio telecommunications transceiver adjunct integrated module.

19. The method of claim 8, wherein the first alarm detector communicates with the monitoring entity disposed remotely with respect to the premises through an intermediary server that links alarm detectors and alarm panels at geographically diverse premises to one or more central monitoring stations.

20. The method of claim 8, wherein the plurality of other alarm detectors comprise a plurality of smoke detectors.

21. The method of claim 20, wherein the plurality of smoke detectors are retrofitted to support short-range wireless communications, wherein the first alarm detector comprises a first smoke detector, and wherein the first smoke detector is retrofitted to support communication via long-range wireless signals over one or more commercial digital cellular telecommunications systems.

22. An alarm detector comprising:

a legacy portion that comprises a sensor operative to sense an alarm event and produce a corresponding alarm notification, including changing a state of a contact; and a retrofit portion that comprises:

an electrical source and an associated electrical lead that is connected to the contact to detect the corresponding alarm notification by determining the state of the contact;

a short-range wireless receiver operative to receive short-range wireless signals conveying alarm notifications from a plurality of other alarm detectors that are disposed locally; and a long-range wireless transmitter operative to transmit the corresponding alarm notification and the conveyed alarm notifications via long-range wireless signals over one or more commercial digital cellular telecommunications systems.

23. The alarm detector of claim 22, wherein the long-range wireless transmitter is operative to transmit the corresponding alarm notification and the conveyed alarm notifications to a smart phone via long-range wireless signals over one or more commercial digital cellular telecommunications systems.

24. The alarm detector of claim 22, wherein transmitting the corresponding alarm notification and the conveyed alarm notifications over the long-range wireless network comprises transmitting an alert over the long-range wireless network in response to an event, and wherein the event comprises at least one of: the corresponding alarm notification being produced; and one or more of the alarm notifications being conveyed from one or more of the plurality of other alarm detectors.

25. The alarm detector of claim 22, wherein the sensor comprises a smoke sensor, and wherein the other alarm detectors comprise other smoke sensors.

26. The alarm detector of claim 22, wherein the short-range wireless receiver comprises a microphone, wherein the corresponding alarm notification comprises an electrical signal, and wherein the short-range wireless signals comprise sound.

27. A retrofit kit for a smoke detector comprising:

a housing that mates with the smoke detector;

a sensor that is mounted to the housing and that is operative to sense when the smoke detector has detected a smoke event and provide an electrical signal when the smoke event is detected; and a digital cellular telecommunications transceiver that is integrated within the housing, that is electrically coupled to the sensor, and that is operative to emit a long-range wireless message in response to receiving the electrical signal, wherein the smoke detector comprises a contact that changes state when the smoke detector detects the smoke event, and wherein the sensor comprises an electrical source and an associated electrical lead for connecting to the contact to sense the smoke event based on determining the state of the contact.

28. The retrofit kit of claim 27, wherein the long-range wireless message is configured for receipt at a smartphone.

29. The retrofit kit of claim 27, further comprising a short-range radio transceiver that is operative to receive radio frequency alarm signals from another smoke detector disposed locally, and wherein the digital cellular telecommunications transceiver is operative to communicate with a remote monitoring entity via long-range wireless signals.

30. The retrofit kit of claim 29, wherein the digital cellular telecommunications transceiver is further operative to communicate with the remote monitoring entity via long-range wireless signals transmitted over one or more commercial digital cellular telecommunications systems.

31. The retrofit kit of claim 27, further comprising a short-range infrared light transceiver that is attached to the housing and that is operative to receive infrared light alarm signals from another smoke detector disposed locally, wherein the digital cellular telecommunications transceiver is operative to communicate with a remote monitoring entity via long-range wireless signals.

32. The retrofit kit of claim 31, wherein the digital cellular telecommunications transceiver is further operative to communicate with the remote monitoring entity via long-range wireless signals transmitted over one or more commercial digital cellular telecommunications systems.

33. The retrofit kit of claim 27, further comprising a short-range radio receiver that is operative to receive radio frequency alarm signals from a plurality of other smoke detectors disposed proximate to the smoke detector.

34. The retrofit kit of claim 27, further comprising a short-range infrared light receiver that is operative to receive infrared light alarm signals from a plurality of other smoke detectors disposed proximate to the smoke detector.

35. The retrofit kit of claim 27, wherein the smoke detector comprises:

a member for mounting to a surface of a building; and a unit that mounts to the member and that houses a smoke sensor, and wherein the housing of the retrofit kit comprises a first side that connects to the member and a second side that connects to the unit.

36. A kit for upgrading an alarm detector from providing a local alarm notification to providing a remote alarm notification, the kit comprising:

a housing that mates with the alarm detector via a receptacle;

a sensor attached to the housing, the sensor comprising an electrical source and an associated electrical lead for connecting to a contact of the alarm detector to detect a state change of the contact indicative of an occurrence of the local alarm notification; and a wireless transceiver integrated within the housing and electrically connected to the sensor, the wireless transceiver operative to send, via long-range wireless signals over one or more commercial digital cellular telecommunications systems, the remote alarm notification to a remote recipient responsive to the sensor detecting the state change of the contact.

37. The kit of claim 36, wherein the remote recipient comprises a smartphone.

38. The kit of claim 36, wherein the alarm detector comprises a smoke alarm, wherein the remote monitoring entity comprises a portable cellular device, and wherein sending the remote alarm notification to the remote monitoring entity via long-range wireless signals, comprises:

transmitting the remote alarm notification to an intermediary server via a long-range wireless network; and transmitting the remote alarm notification from the intermediary server to the portable cellular device.

39. The kit of claim 36, wherein the local alarm notification comprises an audible local alarm notification, wherein the receptacle is sized to fit over the alarm detector, wherein the kit comprises a radio frequency receiver that is attached to the housing, wherein the radio frequency receiver is operative to receive wireless signals from other alarm detectors disposed locally, and wherein the wireless transceiver is operative to send the remote alarm notification to the remote recipient in response to the radio frequency receiver receiving at least one of the wireless signals from at least one of the other alarm detectors that are disposed locally.

40. The kit of claim 36, wherein the local alarm notification comprises an audible sound.

* * * * *